US007627909B2

(12) United States Patent
Esche

(10) Patent No.: US 7,627,909 B2
(45) Date of Patent: Dec. 8, 2009

(54) FAUCET SENSOR MOUNTING ASSEMBLY

(75) Inventor: John C. Esche, Kohler, WI (US)

(73) Assignee: Kohler Co., Kohler, WI (US)

( * ) Notice: Subject to any disclaimer, the term of this patent is extended or adjusted under 35 U.S.C. 154(b) by 430 days.

(21) Appl. No.: 11/731,666

(22) Filed: Mar. 30, 2007

(65) Prior Publication Data

US 2007/0228310 A1 Oct. 4, 2007

Related U.S. Application Data

(60) Provisional application No. 60/787,278, filed on Mar. 30, 2006.

(51) Int. Cl.
*E03C 1/05* (2006.01)

(52) U.S. Cl. ..... 4/623; 4/695; 251/129.04; 251/263

(58) Field of Classification Search ..... 251/129.04, 251/263, 262; 137/801; 4/623, 695
See application file for complete search history.

(56) References Cited

U.S. PATENT DOCUMENTS 1,379,165 A 5/1921 Burns et al.
2,461,354 A * 2/1949 Stone ..... 4/695
2,576,579 A 11/1951 Donavan
2,920,407 A 1/1960 Stathem
4,356,574 A * 11/1982 Johnson ..... 137/801
4,762,273 A * 8/1988 Gregory et al. ..... 251/129.04
5,074,520 A 12/1991 Lee et al.
5,586,746 A * 12/1996 Humpert et al. ..... 251/129.04
5,618,023 A * 4/1997 Eichholz et al. ..... 251/129.04
5,758,688 A 6/1998 Hamanaka et al.
5,918,855 A * 7/1999 Hamanaka et al. ..... 251/129.04
6,082,407 A * 7/2000 Paterson et al. ..... 4/623
6,202,980 B1 3/2001 Vincent et al.
6,219,857 B1 4/2001 Wu
6,294,786 B1 9/2001 Marcichow et al.
6,671,898 B1 * 1/2004 Eggenberger et al. .. 251/129.04
7,003,818 B2 * 2/2006 McNerney et al. ..... 4/695

FOREIGN PATENT DOCUMENTS

EP 0 921 238 A1 6/1999

OTHER PUBLICATIONS

Kohler Co. "Touchless Electric Faucet with Gooseneck Spout for 4" Centers". Online catalog. Admitted prior art.

* cited by examiner

*Primary Examiner*—John Bastianelli
(74) *Attorney, Agent, or Firm*—Quarles & Brady LLP

(57) ABSTRACT

The present invention provides an automatic faucet with a movable cam assembly for mounting the senor and sensor window inside of the faucet body. The cam has an obliquely angled surface and can be moved up against a spring to provide space for assembling the sensor inside the faucet. Once the sensor is properly positioned, the spring drives the wedge-like cam back down to apply a holding force against the sensor and the window. Back pressure against the sensor or window can be absorbed to some extend by the spring to reduce the chance of damaging the window and/or sensor from impact.

16 Claims, 5 Drawing Sheets

FIG. 1
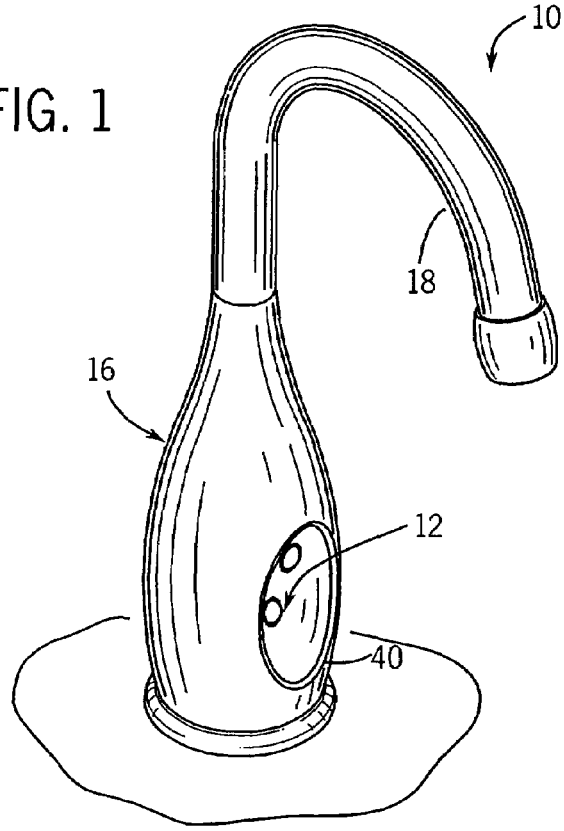
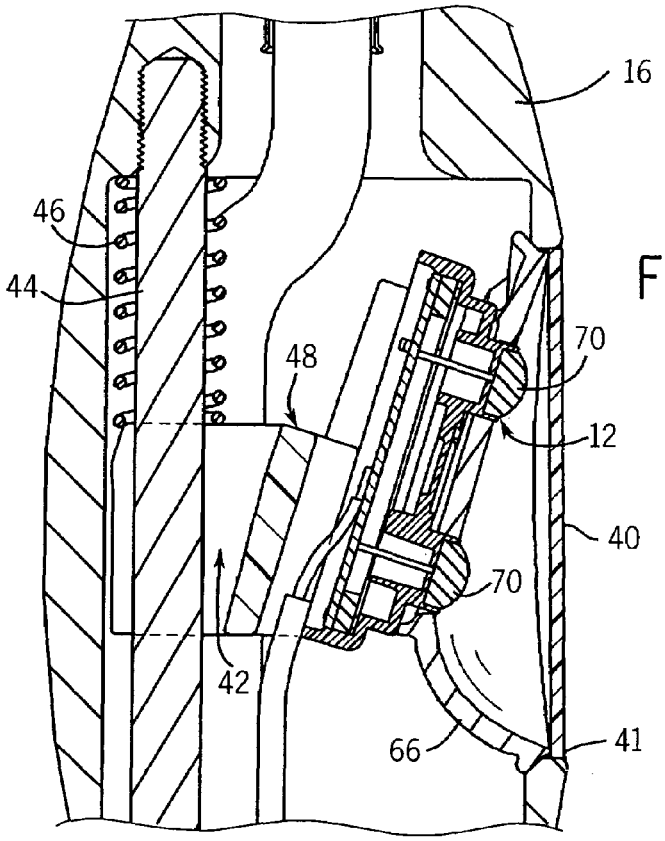
FIG. 6

FAUCET SENSOR MOUNTING ASSEMBLY

CROSS-REFERENCE TO RELATED APPLICATION

This application claims priority to U.S. provisional patent application Ser. No. 60/787,278, filed on Mar. 30, 2006, and entitled "Faucet Sensor Mounting Assembly".

STATEMENT OF FEDERALLY SPONSORED RESEARCH OR DEVELOPMENT

Not applicable.

BACKGROUND OF THE INVENTION

The present invention relates to automatic valve control sensors for plumbing fittings. More particularly it relates to an assembly for mounting the sensors inside of the faucet.

Faucets have control valves for regulating the flow of water through the faucet. There can be a single valve that controls mixed hot and cold water flow or dedicated hot and cold water valves. Depending on the number of valves, one or two handles are typically provided for controlling the operation of the valve(s). Other conventional faucets, commonly referred to as "automatic" or "touchless" faucets, although the user to operate the faucet "automatically". Such automatic faucets typically use some type of sensor to detect the presence of a nearby object. The sensor can be any suitable type of proximity sensor or eye known in the art. When an object is detected, the sensor triggers one or more electronically controlled valves to open and close off flow through the faucet.

One problem with such automatic faucets pertains to the assembly of the sensors properly within the faucet. Line of sight is required for many sensors such that a small window must be assembled over an opening in the faucet body, the window guarding against splashing. The sensors need to be positioned and properly oriented (or pointed) behind the window so that they focus on the area beneath the spout where hands and other objects to be washed are placed. The openings where the window sits and at the bottom of the faucet are usually small and narrow, and thus it is difficult to manually assemble both the window and the sensor(s) in the proper orientation. Manufacturing clearances and irregularities also make it difficult to ensure that these components are properly assembled.

Another problem has to do with the sensors and windows being susceptible to damage. Abusive force on these components can render the faucet inoperable. Thus, while it is important that these components are assembled snuggly and securely inside the faucet, it is also beneficial to allow some give to absorb impact forces on these components.

Hence, a need exists for an improved assembly for installing the sensor and window in automatic faucets.

SUMMARY OF THE INVENTION

The present invention provides an automatic faucet with a movable cam assembly for mounting the senor and sensor window inside of the faucet body. The cam has an obliquely angled surface and can be moved up against a spring to provide space for assembling the sensor inside the faucet. Once the sensor is properly positioned, the spring drives the wedge-like cam back down to apply a holding force against the sensor and the window. Back pressure against the sensor or window can be absorbed to some extend by the spring to reduce the chance of damaging the window and/or sensor from impact.

Specifically, in one aspect the invention provides an assembly for mounting a sensor, for activating a control valve, to a faucet. The assembly includes a mount disposed within an interior of the faucet. A cam has a cam surface extending obliquely to the mount. The cam is movably linked to the mount and movable relative to the sensor. A biasing member biases the cam to apply a holding force to the sensor.

The sensor can be any suitable electrical sensor or photo eye, detecting motion or being responsive to changes in capacitance, light, temperature, local density or any other such parameter. The sensor is electrically coupled to an electrical control for one or more water valves. Detecting of an object under the faucet will activate the valve(s) to open, and detecting that the object is no longer there will close the valve(s).

The mount can be an elongated member. The biasing member can be spring, such as coiled compression type spring, disposed about the elongated member. The cam includes a through opening slidably receiving the mount. The cam is movable along the mount from an lowered position in which the cam is in contact with the sensor to a raised position in which the cam is out of contact with the sensor. The cam surface extends obliquely so as to be closer to the mount nearer its bottom side than its top side. Thus, it acts as a wedge driven down by the spring force to apply a force tending to hold the sensor in its proper mounting position. The cam and spring force further act to bias the sensor window against the faucet. The sensor can rest on a mounting cup disposed between the window and the sensor, and the holding force on the sensor will transfer with the cup to press against the window and hold it in place.

In another aspect the invention provides an automatic faucet having a sensor electrically coupled to a control valve for controlling flow of water through the faucet in response to the detection of the presence or absence of an object near the sensor. The faucet has a sensor mounting assembly as described above, including a mount disposed within an interior of the faucet, a cam movably linked to the mount and having a cam surface oblique to the mount, and a biasing member biasing the cam in contact with the sensor.

Thus, with the present invention, the proper installation of the sensor can be made in the tight space inside the faucet quite quickly. Clearances created by manufacturing irregularities or tolerances with respect to the housing will be automatically taken up to create a tighter fit. Further, the assembly does not need any exposed fasteners. Also, while the assembly resists inadvertent or abusive inward force on the window, it also provides some give if the pressure becomes too high to help reduce breakage.

Other advantages of the invention will be apparent from the detailed description which follows and accompanying drawings. What follows is merely a description of a preferred embodiment of the present invention. To assess the full scope of the invention the claims should be looked to as the preferred embodiment is not intended to be the only embodiment within the scope of the claims.

BRIEF DESCRIPTION OF THE DRAWINGS

FIG. 1 is a perspective view of a plumbing fitting in the form of a kitchen faucet having sensors for detecting the need to open a water valve controlling flow from the faucet, the faucet having a sensor mounting assembly of the present invention;

FIG. 6 is an enlarged sectional view showing the sensor mounting assembly.

DETAILED DESCRIPTION OF THE PREFERRED EMBODIMENT

Figure 2:
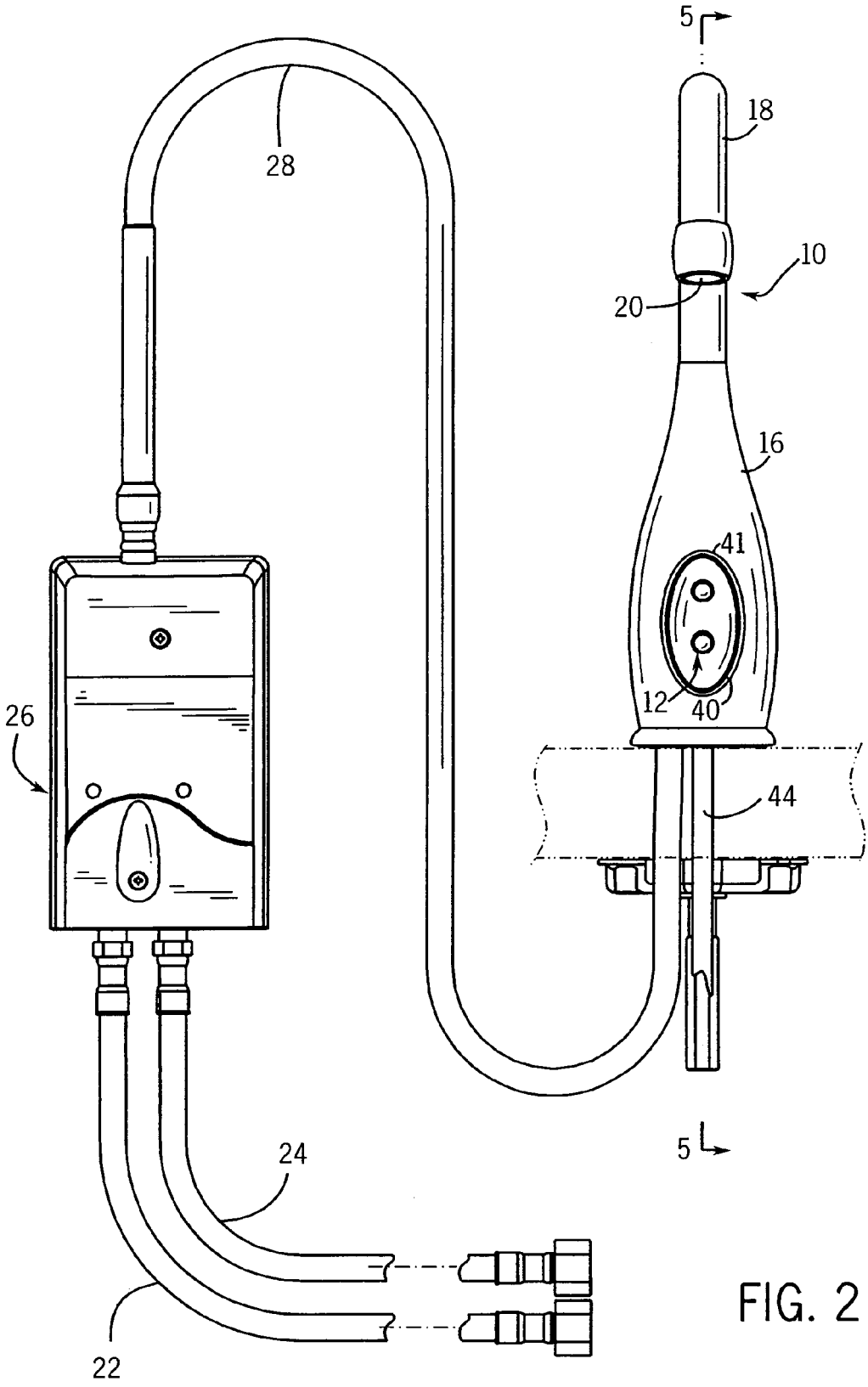
FIG. 2 is an elevational view showing the faucet of FIG. 1 along with water lines and a control valve module.
Figure 3:
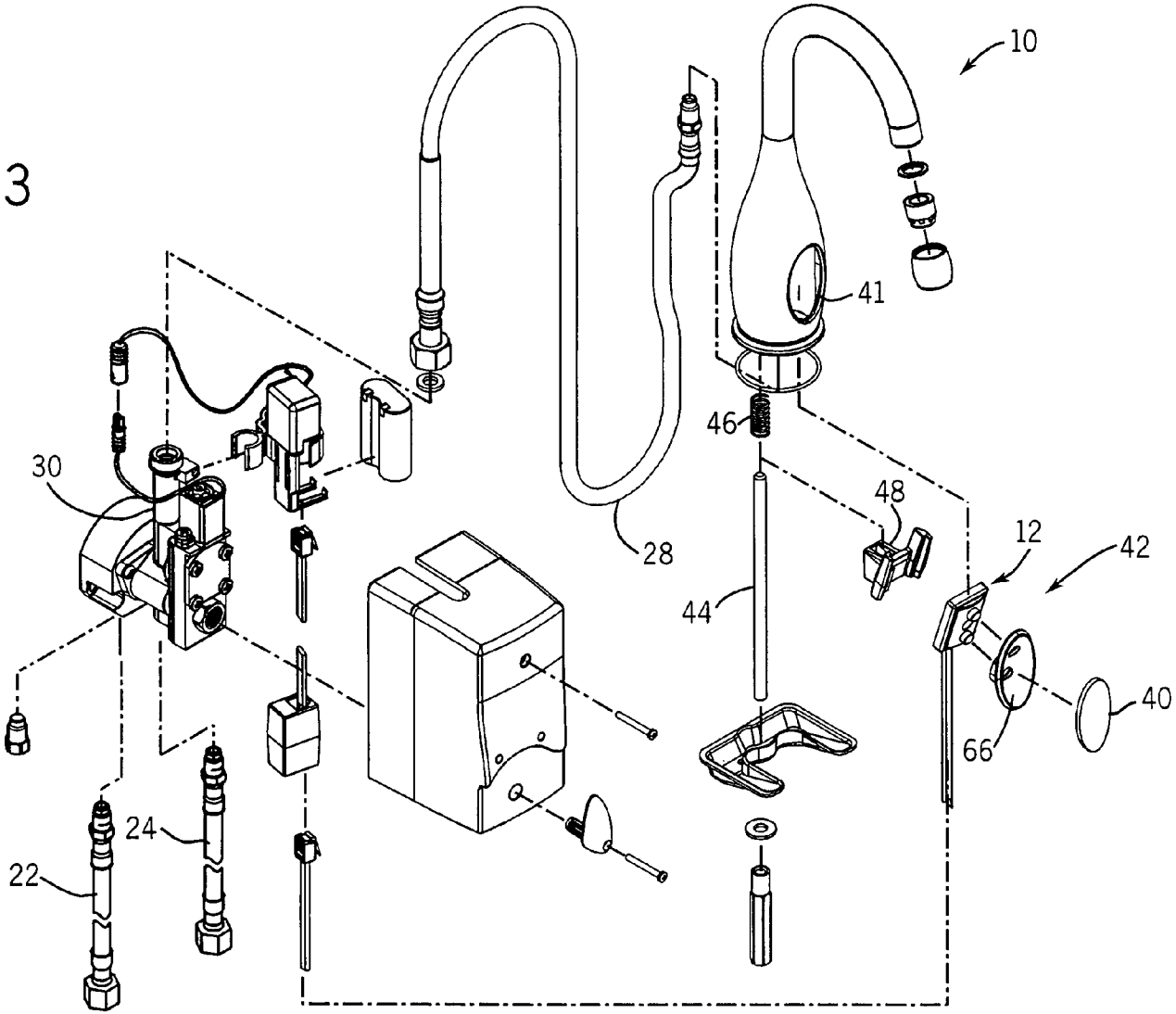
FIG. 3 is an exploded assembly view thereof.

FIGS. 1 and 2 illustrate an exemplary plumbing fitting in the form of a kitchen faucet 10 having a sensor 12 for detecting the need to open/close a water valve controlling flow from the faucet 10. The faucet 10 has an outer housing or faucet body 16 with hooked spout 18 defining a water passage to a spout outlet 20 where water exits the faucet 10. Hot and cold water lines 22 and 24 coupled to the building plumbing system connected to a mixer/control module 26 where the water flow is combined and regulated to the faucet 10 through line 28. The control module 26 includes an electronically controlled valve 30 (see FIG. 3) and is electrically connected to the sensor 12. The sensor 12 is housed inside the faucet body 16 and senses the area beneath the spout outlet 20. An electrical input signal from the sensor 12 is used by the control module 26 to open and close the valve 30 to either turn on or shut off flow through the faucet 10. For example, when a person place his or her hands under the spout 18, the sensor 12 will detect the presence of the hands and signal the control to open the valve 30. After the person removes his or her hands, the sensor 12 will signal the control to close the valve 30. Any additional control parameters can be built into the control module 26, such as timing circuitry or on-demand on/off controls, to regulate the water flow through the faucet 10. Furthermore, any suitable electrical sensor an be used to sense the area and provide the input signal. Motion sensors, photoeyes, heat sensors, capacitance sensors and any other suitable proximity sensors can be used as know in the art.

Figure 4:
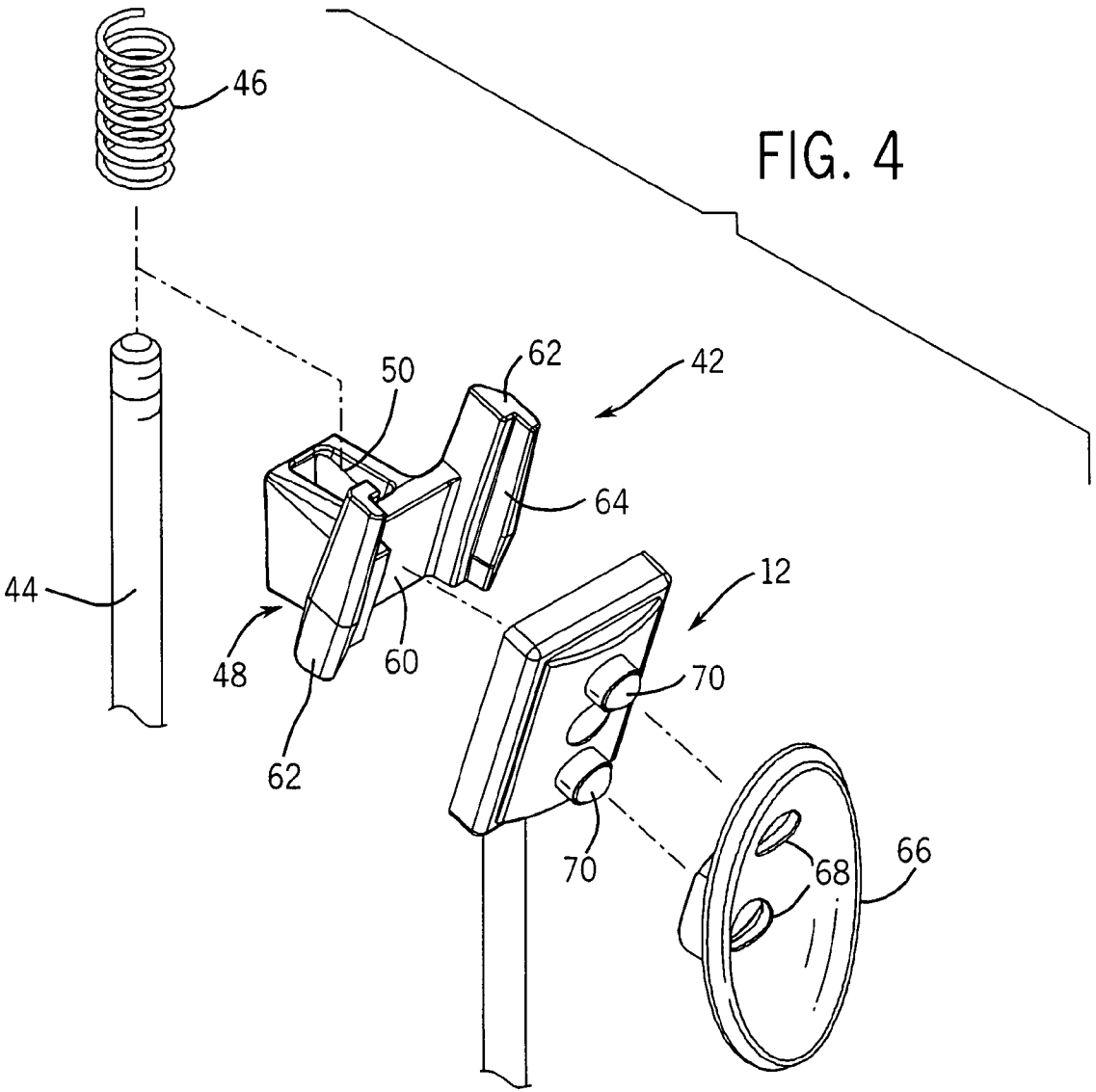
FIG. 4 is an enlarged exploded assembly view of the sensor mounting assembly.
Figure 5:
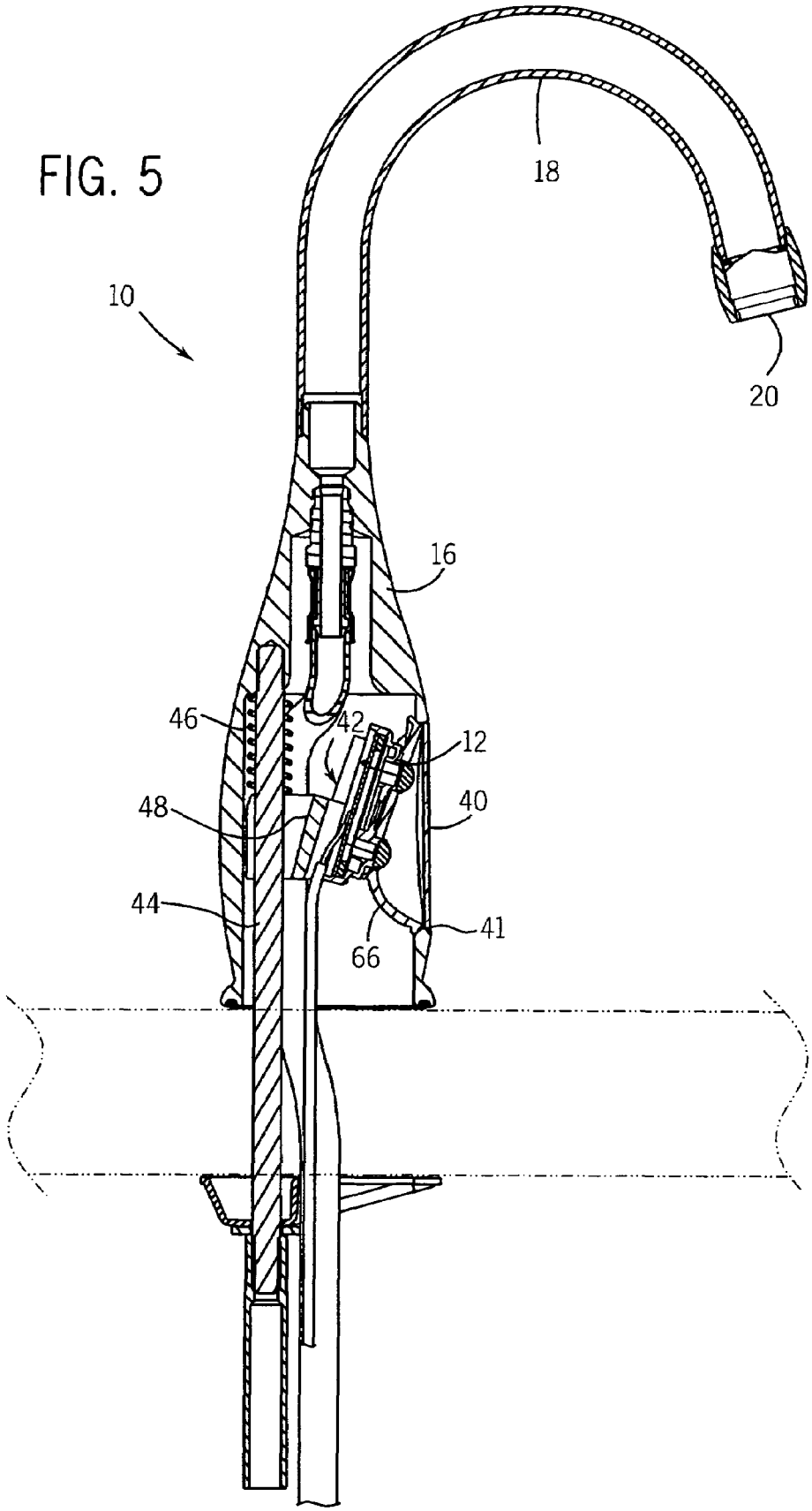
FIG. 5 is a side sectional view taken along line 5-5 of FIG. 2.

Referring to FIGS. 4-6, the sensor 12 is mounted behind a window 40 covering an opening 41 in the front wall of the faucet body 16. A mounting assembly 42 according to the present invention mounts the sensor 12 and the window 40 securely to the faucet body 16. The mounting assembly 42 includes an elongated upright mounting post 44, which can be a threaded rod of an assembly used to mount the faucet 10 to a sink deck or countertop. A coiled spring 46, such as a compression spring, fits about the upper end of the mounting post 44. A wedge cam 48 has a rear section with a through opening 50 that receives the mounting post 44. The cam 48 is mounted below the spring 46 and slide up and down along the mounting post 44. The cam 48 has a cam surface 60 that extends in a plane that is oblique to the long axis of the mounting post 44 and the axis of the opening 50. The cam surface 60 runs at a downward and rearward angle so that the cam surface 60 gets closer to the mounting post axis as extends in the direction of the bottom of the faucet 10. The cam 48 as has winged sides 62 that define a track 64 in which slides the body of the sensor 12. In one alternative embodiment, the faucet 10 does not include a window so that the opening 41 is uncovered.

The sensor 12 sits onto a mounting cup 66 disposed between the sensor 12 and the window 40. The mounting cup 66 can have openings 68 into which eyes 70 of the sensor 12 fit. The sensor 12 is canted downward slightly so that the eyes 70 are directed to an area beneath the spout outlet 20 where hands and items to be washed will be placed when it is desired to turn on the faucet 10. Moreover, the mounting cup 66 has a dished outer surface which can be made reflective by polishing or by treating it with reflective material to enhance the amount of light reaching the eyes 70.

The sensor 12 is installed by manually raising the cam 48 against the force of the spring 46. This creates space between the angled cam surface 60 and the mounting cup 66 to allow the sensor 12 to fit therebetween and the eyes 70 can be fit into the openings 68 in the mounting cup 66. By releasing the cam 48, the spring 46 will drive the cam 48 downward in contact with the body of the sensor 12. The sensor 12 fit into the track 64 in the cam 48, which will continue to slide downward along the track 64 under the spring force until it comes to rest when the spring force is equalized. The spring 46 and cam 48 will thus provide a holding force against the sensor 12, the mounting cup 66 and the window 40 to secure these components to the faucet body 16.

The proper installation of the sensor 12 can thus be made in the tight space inside the faucet quite quickly. Clearances created by manufacturing irregularities or tolerances with respect to the housing will be automatically taken up to create a tighter fit. Further, the mounting assembly does not require any exposed fasteners. Also, while the assembly resists inadvertent or abusive inward force on the window 40, it also provides some give if the pressure becomes too high to help reduce breakage.

While there has been shown and described what is at present considered a preferred embodiment of the invention, various changes and modifications can be made therein without departing from the scope of the invention defined by the appended claims. Therefore, various alternatives and revised embodiments are contemplated as being within the scope of the following claims.

INDUSTRIAL APPLICABILITY

The invention provides an automatic faucet with a cam assembly for mounting the sensors inside of the faucet accurately and quickly.

What is claimed is:

1. A sensor mounting assembly for a faucet, comprising:

a mount disposed within an interior of the faucet;

a cam movably linked to the mount and having a cam surface oblique to the mount;

a sensor for activating a control valve of the faucet; and a biasing member biasing the cam to apply a holding force to the sensor;

wherein the cam is movable relative to the sensor; and wherein there is a window for covering an opening in the faucet, and the cam and biasing member act to bias the window against the faucet.

2. The assembly of claim 1, wherein the sensor is a proximity sensor electrically coupled to an electronic control from the control valve.

3. The assembly of claim 1, wherein the mount is an elongated member and the cam includes a through opening slidably receiving the mount.

4. The assembly of claim 3, wherein the cam surface is oblique to the through opening.

5. The assembly of claim 1, wherein the cam defines a track along which the sensor can slide.

6. The assembly of claim 1, wherein the biasing member acts directly against the cam.

7. The assembly of claim 1, wherein the mount is an elongated member, the biasing member is a coil spring disposed about the elongated member, and the cam includes a through opening slidably receiving the mount.

8. The assembly of claim 1, wherein the mount has a top side and a bottom side associated with a respective top and bottom of the faucet, and wherein the cam surface extends obliquely so as to be closer to the mount nearer the bottom side than the top side.

9. The assembly of claim 1, wherein the cam is movable along the mount from a first position in which the cam is in contact with the sensor to a second position in which the cam is out of contact with the sensor.

10. The assembly of claim 1, further including a mounting cup disposed between the window and the sensor.

11. An automatic faucet having a sensor electrically coupled to a control valve for controlling flow of water through the faucet in response to the detection of the presence or absence of an object near the sensor, the faucet having a sensor mounting assembly, comprising:

a mount disposed within an interior of the faucet;

a cam movably linked to the mount and having a cam surface oblique to the mount; and a biasing member biasing the cam in contact with the sensor;

wherein the cam is movable relative to the sensor; and wherein the mount is an elongated member, the biasing member is a coil spring disposed about the elongated member, and the cam includes a through opening slidably receiving the mount.

12. The faucet of claim 11, wherein the mount has a top side and a bottom side associated with a respective top and bottom of the faucet, and wherein the cam surface extends obliquely so as to be closer to the mount nearer the bottom side than the top side.

13. The faucet of claim 11, wherein the cam is movable along the mount from a first position in which the cam is in contact with the sensor to a second position in which the cam is out of contact with the sensor.

14. The faucet of claim 11, wherein the faucet has an opening in a side of its body and wherein the assembly further includes a window covering said opening in the faucet.

15. The faucet of claim 14, wherein the cam and biasing member act to bias the window against the faucet.

16. The faucet of claim 14, further including a mounting cup disposed between the window and the sensor.

* * * * *